US012127585B2

(12) United States Patent
Rushforth et al.

(10) Patent No.: US 12,127,585 B2
(45) Date of Patent: Oct. 29, 2024

(54) CONTAINER

(71) Applicant: BRITISH AMERICAN TOBACCO (INVESTMENTS) LIMITED, London (GB)

(72) Inventors: David Rushforth, London (GB); Paul Gibson, London (GB); Eva Sommarstrom, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 24 days.

(21) Appl. No.: 14/785,590

(22) PCT Filed: Apr. 15, 2014

(86) PCT No.: PCT/GB2014/051169

§ 371 (c)(1),
(2) Date: Oct. 19, 2015

(87) PCT Pub. No.: WO2014/170654

PCT Pub. Date: Oct. 23, 2014

(65) Prior Publication Data

US 2016/0058069 A1 Mar. 3, 2016

(30) Foreign Application Priority Data

Apr. 18, 2013 (GB) ..... 1307024

(51) Int. Cl.
*A24F 23/00* (2006.01)
*A24F 25/00* (2006.01)
(Continued)

(52) U.S. Cl.
CPC ..... *A24F 25/00* (2013.01); *A24F 23/00* (2013.01); *B65D 25/02* (2013.01); *B65D 25/14* (2013.01); *B65D 51/24* (2013.01); *B65D 81/2069* (2013.01)

(58) Field of Classification Search
CPC ..... A24F 23/00; B65D 25/14
(Continued)

(56) References Cited

U.S. PATENT DOCUMENTS 224,632 A * 2/1880 Berry ..... B65D 1/36 206/564
1,935,840 A * 11/1933 Fitzgerald ..... A24F 23/02 206/236
(Continued)

FOREIGN PATENT DOCUMENTS

DE 1959102 A1 5/1971
EP 2454954 A1 5/2012
(Continued)

OTHER PUBLICATIONS

Definition of Separate, Merriam-Webster Dictionary, https://www.merriam-webster.com/dictionary/separate (Year: 2019).*
(Continued)

*Primary Examiner* — Russell E Sparks
(74) *Attorney, Agent, or Firm* — McKee, Voorhees & Sease, PLC

(57) ABSTRACT

A container comprising a main body and a lid includes a chamber for a recipient product. A portion of the container is provided with a sensate substance which is released into the chamber to impart an organoleptic characteristic to a recipient product within the chamber. The recipient product can be a smokeless tobacco product.

18 Claims, 3 Drawing Sheets

(51) Int. Cl.

| | |
|---|---|
| ***B65D 25/02*** | (2006.01) |
| ***B65D 25/14*** | (2006.01) |
| ***B65D 51/24*** | (2006.01) |
| ***B65D 81/20*** | (2006.01) |

(58) Field of Classification Search
USPC ..... 131/309
See application file for complete search history.

(56) References Cited

U.S. PATENT DOCUMENTS

| | | | | |
|---|---|---|---|---|
| 1,972,118 | A | 9/1934 | McDill | |
| 2,357,258 | A * | 8/1944 | Harris | A23L 27/70 174/102 P |
| 3,688,985 | A * | 9/1972 | Engel | A61K 8/02 239/54 |
| 4,269,203 | A | 5/1981 | Corbett | |
| 4,540,721 | A * | 9/1985 | Staller | A61L 9/042 239/54 |
| 4,598,006 | A * | 7/1986 | Sand | A61K 9/7007 514/291 |
| 4,686,353 | A | 8/1987 | Spector | |
| 4,706,837 | A | 11/1987 | Cooke | |
| 4,814,212 | A * | 3/1989 | Spector | G09F 21/04 239/57 |
| 5,832,934 | A | 11/1998 | Schmidt | |
| 5,938,018 | A | 8/1999 | Keaveney et al. | |
| 7,648,024 | B2 * | 1/2010 | Mitten | B65D 43/20 206/236 |
| 8,109,409 | B1 | 2/2012 | MacMurray | |
| 8,894,478 | B1 * | 11/2014 | Stillwagon | F24F 1/0071 454/249 |
| 2001/0000235 | A1 * | 4/2001 | Bowen | A61L 9/12 428/500 |
| 2004/0018278 | A1 * | 1/2004 | Popplewell | B32B 27/18 426/132 |
| 2004/0170780 | A1 | 9/2004 | Giraud | |
| 2007/0012696 | A1 * | 1/2007 | Levie | B65D 21/086 220/8 |
| 2008/0210249 | A1 | 9/2008 | Luzenberg | |
| 2009/0014343 | A1 * | 1/2009 | Clark | A24F 23/00 206/247 |
| 2009/0266910 | A1 | 10/2009 | Hunter | |
| 2010/0000888 | A1 | 1/2010 | Cronin et al. | |
| 2011/0083677 | A1 | 4/2011 | Carroll et al. | |
| 2011/0253562 | A1 * | 10/2011 | Machado | B65D 81/28 206/213.1 |
| 2011/0303566 | A1 * | 12/2011 | Gibson | B65D 43/0222 206/246 |
| 2013/0008809 | A1 * | 1/2013 | Cortez | B65D 43/0229 206/265 |
| 2013/0157827 | A1 * | 6/2013 | Boldrini | B65B 29/00 493/186 |
| 2013/0262345 | A1 * | 10/2013 | Ciavarella | A47K 5/1208 705/500 |
| 2016/0073680 | A1 | 3/2016 | Rushforth et al. | |
| 2016/0073681 | A1 | 3/2016 | Rushforth et al. | |

FOREIGN PATENT DOCUMENTS

| | | | |
|---|---|---|---|
| EP | 2548816 | A1 | 1/2013 |
| FR | 2504498 | A1 | 10/1982 |
| FR | 2907703 | A1 | 5/2008 |
| JP | 4939779 | | 4/1974 |
| JP | 5217149 | U | 2/1977 |
| JP | 2002248160 | A | 9/2009 |
| JP | 2010525992 | A | 7/2010 |
| JP | 2011000004 | A | 1/2011 |
| JP | 2012518576 | A | 8/2012 |
| JP | 2013507106 | A | 3/2013 |
| JP | 2016516425 | A | 6/2016 |
| WO | 2008148702 | A1 | 12/2008 |
| WO | 2010147024 | A1 | 12/2010 |
| WO | 2011042171 | A1 | 4/2011 |
| WO | 2011061130 | A1 | 5/2011 |
| WO | 2011096256 | A1 | 8/2011 |
| WO | 2011108385 | A1 | 9/2011 |
| WO | 2011114528 | A1 | 9/2011 |
| WO | 2012053048 | A1 | 4/2012 |

OTHER PUBLICATIONS

Merriam-Webster Dictionary, Definition of Sensate, https://www.merriam-webster.com/dictionary/sensate (Year: 2020).*

Merriam-Webster Dictionary, Definition of Chamber, https://www.merriam-webster.com/dictionary/chamber (Year: 2021).*

Merriam-Webster Dictionary, Definition of Flavor, https://www.merriam-webster.com/dictionary/flavor (Year: 2021).*

Anonymous, "Why is Cedar Used in Humidors", CheapHumidors.com Blog, Nov. 1, 2010, XP055131061, Retrieved from the Internet: URL:http://www.cheaphumidors.com/blog/humidors/why-is-cdar-used-in-humidors/[retrieved on Jul. 23, 2014]. Nov. 1, 2010.

European Patent Office, "Written Opinion of the International Searching Authority", issued in connection to International Application No. PCT/GB2014/051169, mailed Oct. 18, 2015, 7 pages. Oct. 18, 2015.

European Patent Office, "International Preliminary Report on Patentability", issued in connection to International Application No. PCT/GB2014/051169, mailed Oct. 18, 2015, 8 pages. Oct. 18, 2015.

* cited by examiner

CONTAINER

CROSS-REFERENCE TO RELATED APPLICATIONS

This application is the National Stage of International Application No. PCT/GB2014/051169, filed Apr. 15, 2014, which claims priority to and benefit of Great Britain Patent Application No. 1307024.8, filed Apr. 18, 2013.

FIELD

This invention relates to a container, specifically but not exclusively to a container for a snus smokeless tobacco product.

BACKGROUND

Snus tobacco may be sold either in loose form or in portions disposed in permeable bags and is packaged in portable containers having a re-closable lid to maintain the moisture of the snus during transport, storage and display of the product. Snus is typically consumed by placing it under the upper lip for an extended period of time.

SUMMARY

In accordance with embodiments of the invention, there is provided a container comprising a main body and a lid which define a chamber for a recipient product, wherein a portion of the container is provided with a sensate substance which is released into the chamber to impart an organoleptic characteristic to a recipient product within said chamber.

In one example, the main body may comprise the portion of the container which is provided with a sensate substance.

In another example, the lid may comprise the portion of the container which is provided with a sensate substance.

The portion of the container which is provided with a sensate substance may be an internal surface of the chamber.

Alternatively, the container may comprise a permeable layer disposed between the portion of the container provided with a sensate substance and said chamber.

The container may comprise a material which contains a sensate substance.

The container may be provided with an inner layer which is provided with a sensate substance and which may be integrally formed with the container.

The container may comprise an insert which is received in the container, said insert being provided with a sensate substance which is released into said chamber.

The insert may be received within the main body of the container, said insert defining at least a part of the internal surface of the chamber.

The insert may be shaped to match the internal shape of the main body such that the insert is received within the main body and covers the internal surface of said main body to define said chamber.

Alternatively, the insert may be a different shape to the internal shape of the main body, so that it only partially covers the internal surface of the chamber.

The insert may be shaped to match the internal shape of the lid such that the insert is received within the lid and covers the internal surface of said lid to define said chamber.

The insert may be received in a recess formed in an internal surface of the chamber.

The chamber may contain one or more recipient products.

The recipient product may be a smokeless tobacco product.

The recipient product may be a snus tobacco product.

The recipient product may be a snus tobacco.

The container may be pocket-sized.

In accordance with embodiments of the invention, there is also provided an insert for a container for recipient products, said insert being receivable within said container and being provided with a sensate substance which is released into a chamber of the container to impart an organoleptic characteristic on the recipient product within said container In accordance with embodiments of the invention, there is also provided a method of providing a recipient product received in a chamber of a container with an organoleptic characteristic, comprising the step of providing a portion of the container with a sensate substance which is released into the chamber to impart an organoleptic characteristic on the recipient product within said container.

BRIEF DESCRIPTION OF THE DRAWINGS

Embodiments of the invention will now be described, by way of example only. With reference to the accompanying drawings, in which.

DETAILED DESCRIPTION

Figure 1:
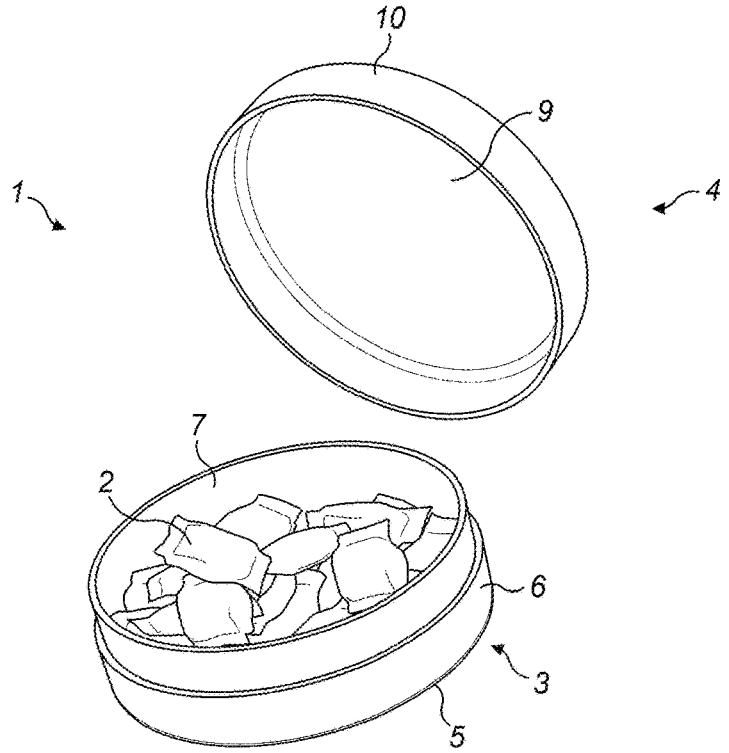
FIG. 1 shows a container for snus tobacco pouches having a main body and a removable lid.

FIG. 1 shows a container 1 for snus tobacco pouches 2 which comprises a main body 3 and a removable lid 4. The examples shown in FIGS. 1 to 5 each relate to a round container which is pocket-sized for the convenience of the consumer, although it will be appreciated that other shapes and sizes are also possible and fall within the scope of the invention as defined in the claims.

The container can be made from a rigid material. For example, the container may be made from a polymer, such as polypropylene, polyethylene, high-density polyethylene, or acrylic, or a metal, such as aluminum or tin. Other suitable materials could include cellulose acetate, or composite materials such as a polymer fibrous composite. Alternatively, any other rigid and lightweight material may be suitable.

The main body 3 of the container 1 comprises a planar bottom wall 5 and a cylindrical side wall 6 which extends perpendicularly to the bottom wall 5 to define a chamber 7 which is closed by the removable lid 4. The lid comprises a planar top wall 9 with a cylindrical side wall 10 that extends perpendicularly to the top wall 9. The cylindrical side wall 10 of the lid 4 and the cylindrical side wall 6 of the main body 3 are configured to have a push-fit relationship in the region where the two overlap, to allow the lid 4 to be removably attached to the main body 3. As shown in FIG. 1, the side wall 6 of the main body 3, or the side wall 10 of the lid 4, may be stepped such that when the lid 4 is attached to the main body 3 the outer circumferential face of the assembled container is level and smooth.

In this example, the chamber 7 within the container 1, as defined between the main body 3 and the lid 4, is for containing a smokeless snus tobacco product which may be provided, in pouches 2 for the consumer's convenience, as shown in FIG. 1. However, it will be appreciated that the container 1 of the invention may instead be used for other products, such as loose snus tobacco, loose rolling tobacco or other tobacco products, smokeless or otherwise. Also, non-tobacco products, such as inert materials with or without nicotine, or plant matter other than tobacco, could be used. The smokeless snus tobacco product (or alternative) contained in the primary chamber 7 may be known as the recipient product.

It is important that the freshness of tobacco products such as those listed as examples above is maintained from the time of packaging to the time when a consumer opens the container and beyond until the product has been consumed. One characteristic of tobacco is that it is moist and to remain fresh it must not be allowed to dry out. Therefore, the main body 3 and lid 4 of the container shown in FIG. 1 are configured to seal the chamber 7 from the atmosphere outside the container 1. That is, the push-fit or otherwise between the lid 4 and main body 3 is tight enough to restrict air flow therethrough. The container may also include a sealing gasket to help with the restriction of air flow.

It is noted that in some embodiments, the main body 3 and lid 4 of the container shown in FIG. 1 may hermetically seal the chamber 7 from the atmosphere outside the container 1.

As shown in FIG. 1, the lid 4 of the container 1 attaches to the main body 3 by means of a push fit—the tolerance between the lid 4 and the main body 3 is tight so that the consumer must push the lid 4 firmly onto the main body 3 to close the container 1. This ensures that the container 1 is adequately sealed from the outside environment while still being removable to allow the consumer to open the container and retrieve the products 2. It will be appreciated that the lid 4 may alternatively be attachable to the main body 3 of the container 1 in other ways, for example, the lid and main body may be provided with screw elements that engage with each other so that the lid is screwed onto the main body. Any other suitable method of allowing the lid 4 to be attachable to the main body 3 may also be used.

Figure 2:
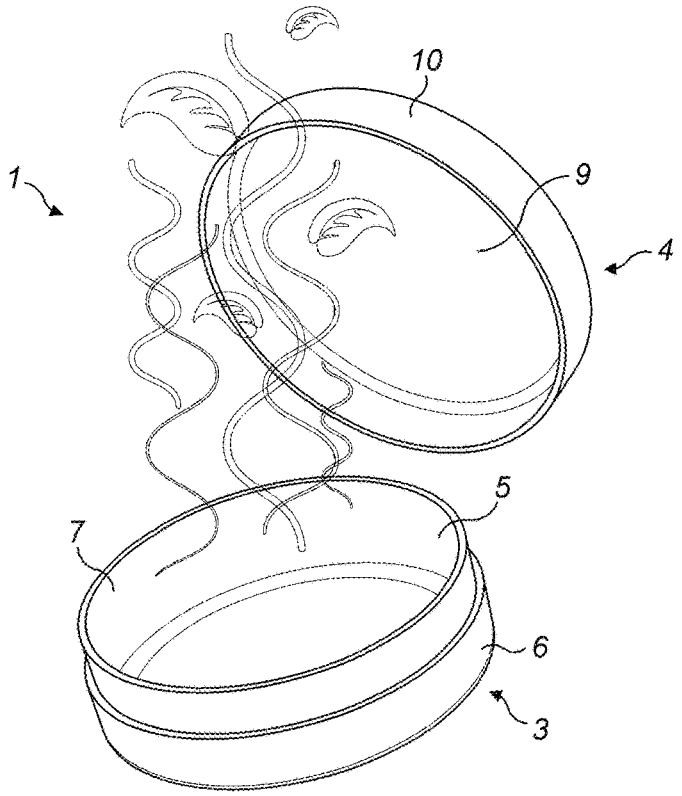
FIG. 2 shows an example of a container of the invention, wherein the container is provided with a sensate substance.

FIG. 2 shows a first example of the invention, wherein at least part of an interior surface of a container 1 similar to that described with reference to FIG. 1 is provided with a sensate substance such that products placed in the container 1 are imparted with an organoleptic characteristic. A sensate substance will impart a characteristic on the recipient products that can be perceived by the senses. In particular, the sensate substance may impart a flavour and/or an aroma to the recipient products.

As shown in FIG. 2, the container 1 has a main body 3 and a lid 4 which are similar to those described with reference to FIG. 1, although it will be appreciated that other shapes and lid attachment means also fall within the invention as defined in the claims. The chamber 7 of the container 1 is defined within the space created between the bottom wall 5 and side wall 6 of the main body 3 and the top wall 9 and side wall 10 of the lid 4. Therefore, when products are placed within the chamber 7 they are surrounded by and may be in contact with these surfaces.

A portion of the material that forms the chamber 7 of the container 1 of FIG. 2 is provided with a sensate substance that is emitted into the chamber 7 and thereby transferred to products placed in the chamber 7 such that an organoleptic characteristic is imparted on those products.

In this example, the interior surfaces of the top, bottom and side walls 5, 6, 9, 10 of the main body 3 and lid 4 are provided with a sensate substance. In this way, when products are placed into the chamber 7 and the lid 4 is attached to the main body 3 the sensate substance is emitted into the chamber 7 and is transferred to the products. The products 2 may also contact the material that is provided with a sensate substance so that the sensate substance is transferred directly to the products 2.

In a first example of the container described with reference to FIG. 2, at least one of the main body 3 and/or lid 4 are made from a material which is provided with a sensate substance.

The main body and/or lid of the container may be entirely made from the material provided with a sensate substance, in which case the sensate substance will be emitted into the area surrounding the container and will also be transferred to any surfaces contacting the container, to give an indication of what organoleptic characteristic the product has been imparted with.

Figure 3:
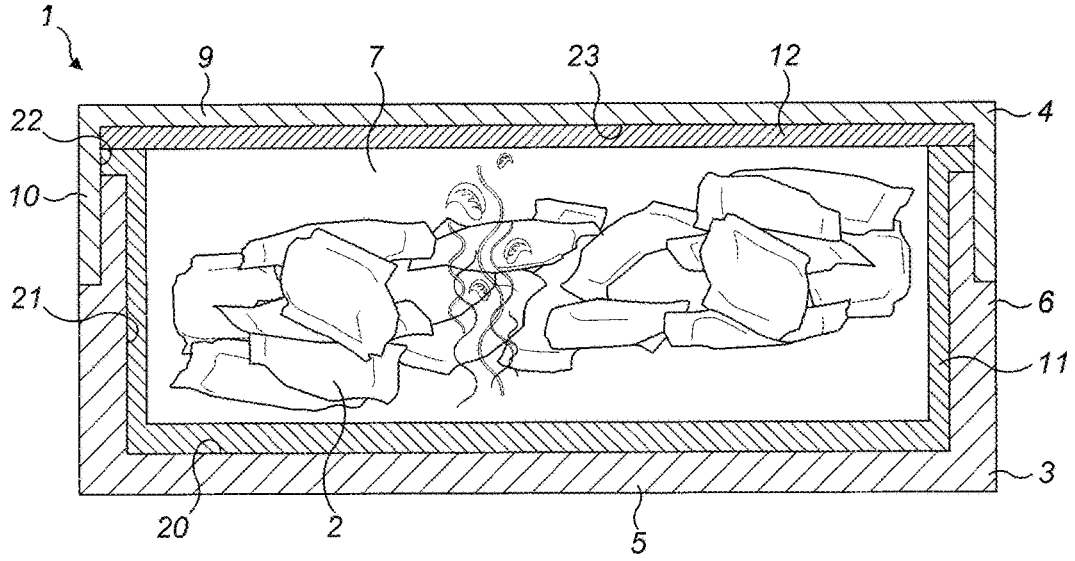
FIG. 3 shows a cross-sectional view of one example of the container of FIG. 2.

In a second example of the container described with reference to FIG. 2, the main body and/or lid of the container may be made from multiple layers, as shown in FIG. 3, the inner most of those being made from a material which is provided with a sensate substance. To achieve this, the container may be manufactured using a multiple-shot injection moulding process, where a single moulding is produced from multiple different materials in a machine cycle. In particular, this process may be used to produce a container with an inner layer that is provided with a sensate substance and an outer layer which is not provided with a sensate substance, as shown in FIG. 3. In this way, the main body and/or lid of the container can provide a sensate substance to the chamber, whilst any emission of the sensate substance from external faces of the container 1 is reduced.

In particular, the container 1 shown in FIG. 3 has a main body 3 and lid 4 as previously described with reference to FIG. 1. However, in this case the main body 3 comprises an integral inner layer 11 which is provided with a sensate substance. The integral inner layer 11 covers a bottom surface 20 of the chamber, on the on the bottom wall 5 of the container, and an inner surface 21 of the side wall 6 of the container 1. Similarly, the lid 4 also has an integral inner layer 12 which is provided with a sensate substance. As shown in FIG. 3, the inner layer 12 of the lid 4 only covers the inner surface 23 of the top wall 9, and not the inner surface 22 of the side wall 10 of the lid 4. However, it will be appreciated that different parts of the inner surfaces 20, 21, 22, 23 of the chamber 7 may comprise a material provided with a sensate substance which forms an inner layer 11, 12 of the container and still fall within the invention as defined in the claims. In one example, only the inner material of a bottom surface 20 of the chamber 7 might be provided with a sensate substance. Alternatively, only a portion of one of the surfaces may be provided with an inner layer of material provided with a sensate substance.

The inner layers 11, 12 provided with a sensate substance are integrally formed with the main body 3 and lid 4 respectively during the multiple-shot moulding process when the different materials are formed together in such a way as they are fused together and are inseparable. Alternatively, the inner layers 11, 12 may be formed separately to the main body 3 and lid 4 and then assembled together with the main body 3 and lid 4 afterwards. Any other suitable method of producing the main body 3 and lid 4 with the inner layers 11, 12 provided with a sensate substance could also be used.

As shown in FIG. 3, when products 2, such as snus pouches, are placed in the chamber 7 of the container they are directly exposed to, surrounded by and in contact with the inner layers 11, 12 and so the sensate substance being emitted from the inner layers 11, 1 is transferred to the products 2.

It will be appreciated that in an alternative example the sensate substance may be provided to a portion of the container that does not form an innermost internal surface of the container. For example, a multiple-shot forming process or a coating process may be used to provide a container having a portion of material provided with a sensate substance and a permeable layer provided between that material and the chamber such that the permeable layer forms at least a part of the surface of the chamber. In this example, the sensate substance released by the portion of the container provided with the sensate substance can pass through the permeable layer and into the chamber to impart an organoleptic characteristic to products in the chamber.

Figure 4:
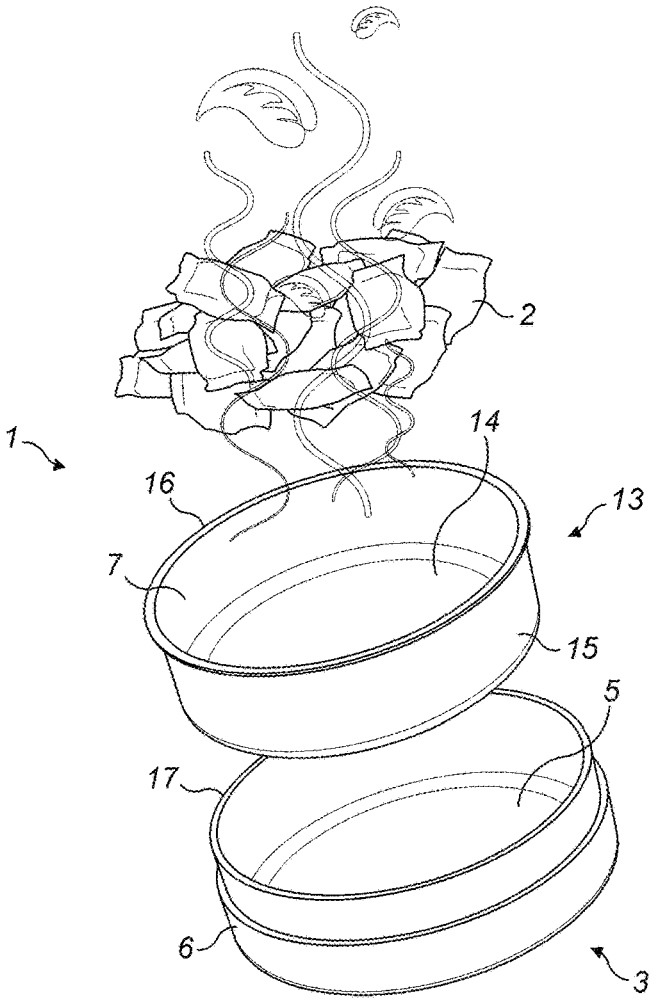
FIG. 4 shows another example of a container of the invention, having a liner which is provided with a sensate substance.

FIG. 4 shows a further example of a container of the invention which comprises a main body 3 and a lid (not shown) similar to those described with reference to FIG. 1. In this example, the container further comprises a liner insert 13 which is a separate component to the main body 3. The main body 3 of the container 1 is made from a material that is not provided with a sensate substance, for example a polymer or metal material (or any of the other suitable materials discussed earlier with reference to FIG. 1). The liner insert 13 is made from a material which is provided with a sensate substance such that the sensate substance is transferred to products 2 placed in the container 1 to impart au organoleptic characteristic to those products 2.

The liner insert 13 is formed to cover at least a part of the inside surface of the bottom wall 5 and side wall 6 of the main body 3 so that at least a part of the chamber 7 is defined by the liner insert 13. Therefore, when products 2 are placed in the chamber 7 the products 2 will be in proximity to, or in contact with, the liner insert 13 to allow transfer of the sensate substance.

In the example shown in FIG. 4, the liner insert 13 is formed to match the internal shape of the main body 3. The liner insert 13 has a bottom wall 14 and a side wall 15 which extends perpendicularly to the bottom wall 14 and defines a space therein which is the chamber 7 for receiving the products. The side wall 15 of the liner insert 13 may also include a lip 16 extending from the edge of the side wall 15 so that when the liner insert 13 is received within the main body 3 the lip 16 extends over an edge 17 of the side wall 6 of the main body 3.

To retain the liner insert 13 within the main body 3 the exterior dimensions of the liner insert 13 may be the same or very close to the interior dimensions of the main body 3, such that the liner insert 13 is a close fit within the main body 3. In particular, the liner insert 13 may be a push-fit or interference fit with the main body 3 so that the liner insert 13 is retained in the main body 3 after insertion. Alternatively or additionally, the liner insert 13 may be adhered to the main body 3 such that the liner insert 13 is retained in the main body 13.

It will be appreciated that the liner insert 13 may alternatively be received in the lid of the container in the same way as described above. Alternatively, both the main body 3 and the lid may be provided with a liner insert 13 such that the entire inner surface of the chamber 7 is formed from a material which is provided with a sensate substance, giving a greater surface area for transferring the sensate substance to recipient products.

Figure 5:
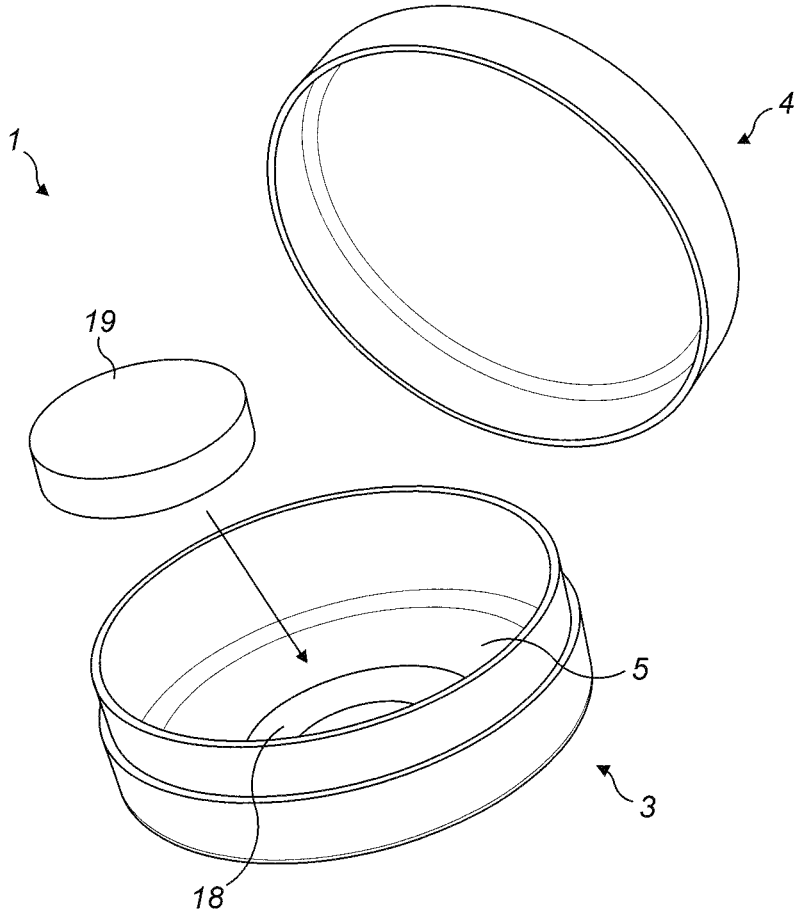
FIG. 5 shows another example of a container of the invention, having an insert which is provided with a sensate substance.

FIG. 5 shows another example of a container which imparts an organoleptic characteristic on products received within the container 1. In this example, a recess 18 is formed in the bottom wall 5 of the main body 3 of the container and an insert 19 can be inserted into that recess 18. The recess 18 and insert 19 may have any regular or irregular shape. For example, the recess 18 and insert 19 shown in FIG. 5 are oval shaped but may alternatively be circular, triangular or star shaped.

Similar to the example described with reference to FIG. 4, the main body 3 of the container 1 is made from a material that is not provided with a sensate substance, for example a polymer or metal. The insert 19 is made from a material which is provided with a sensate substance, such that the sensate substance is emitted from the insert 19 and thereby transferred to products 2 placed in the container 1 to impart an organoleptic substance to those products 2.

The insert 19 may be configured such that there is a push-fit or interference fit relationship between the insert 19 and recess 18, so that the insert 19 is retained in the recess 18 once inserted. Adhesive may also be provided between the insert 19 and the recess 18 to retain the insert 19 in place. Alternatively, the insert 19 may be a loose fit within the recess 18 so that a consumer can easily remove the insert 19 to stop further transfer of the organoleptic substance or to change the insert 19.

The thickness of the insert 19 may be equal to the depth of the recess 18 so that the surface of the chamber 7 is smooth once the insert 19 has been received in the recess 18. Alternatively, the thickness of the insert 19 may be greater than the depth of the recess 18 such that, when the insert 19 is received in the recess 18, it protrudes into the chamber 7 and increases the surface area of material of the insert 19 in the chamber 7. Moreover, the protruding part of the insert 19 will allow a consumer to grip the insert 19 and remove it from the recess 18. It will be appreciated that the recess 18 for receiving the insert 19 may be alternatively be formed in the lid of the container 1.

The insert 19 of FIG. 5 or the liner insert 13 of FIG. 4 may be coloured to indicate the organoleptic characteristic that they will impart on the products in the container. For example, an insert that will impart a menthol characteristic may be coloured green.

The insert 19 of FIG. 5 or the liner insert 13 of FIG. 4 may be placed in the container 1 during the process of packaging the products 2, so that transfer of the sensate substance from the material provided with a sensate substance to the recipient products occurs from packaging, through storage, transport and sales display and onwards until the container is opened and all of the products have been consumed. However, it will be appreciated that the inserts 19, 13 may alternatively be separate from the container so that the consumer places the insert 19, 13 into the container 1 if and when they desire. Therefore, the consumer can select when to impart an organoleptic characteristic to the products. In this case, the insert 13, 19 may be provided in a sealed wrap such that the sensate substance is retained in the insert until the wrap is opened and the insert is placed in the container for use.

The examples of containers 1 described with reference to any of FIGS. 2 to 5 will impart an organoleptic characteristic on recipient products 2 placed within the container 1. In particular, in each of the examples described with reference to FIGS. 2 to 5, at least a portion of the container is provided with a sensate substance that is emitted into the chamber 7 where products are received to impart an organoleptic characteristic on those recipient products.

Providing the products 2 within the containers with an organoleptic characteristic will counteract any reduction in the intensity of the flavour and/or aroma of the product resulting from the product being within the container between packaging and first opening. Therefore, the consumer is presented with a fresh product on first opening and after first opening the freshness of the remaining products is maintained.

In each of the example containers described with reference to FIGS. 2 to 5, at least a portion of the container is provided with a sensate substance. The material of this portion may be provided with a sensate substance by means of infusion, sorption (adsorption or absorption) or any other means of providing a material with a sensate substance in such a way that the sensate substance can be released from the material.

For example, the material provided with a sensate substance may be made from a polymer material which is infused or impregnated with a sensate substance during manufacture of that material.

Another example of such a material that is provided with a sensate substance may be a polymer foam which is formed into the required shape and then exposed to the sensate substance which is absorbed by the foam. The sensate substance is retained and gradually released over time. The rate of release may be accelerated by warming the material.

Another example of a material which may be provided with a sensate substance, as described with reference to FIGS. 2 to 5, is a material comprised of cellulose acetate fibres which absorb the sensate substance. The inner layer of the two-shot components shown in FIG. 3, or the inserts 13, 19 of FIGS. 4 and 5, may be made from cellulose acetate fibres that have absorbed the sensate substance.

Another example of a material that may be provided with a sensate substance is a botanical, absorbent material such as a wood material, which may make up all or a part of any of the components of the containers that are provided with a sensate substance, as described with reference to FIGS. 4 and 5. Wood is naturally absorbent and any absorbed sensate substance would be gradually released. The wood may be a natural or processed wood. Another suitable botanical, absorbent material could be a tobacco material. Of course, the botanical, absorbent material such as the wood or tobacco may itself contribute to the sensate substance.

The sensate substance provides an organoleptic characteristic to the recipient products in the container. A sensate substance can be perceived through the senses and will impart an organoleptic characteristic to the recipient products, which can also be perceived through the senses.

The sensate substance may be a volatile substance, such as an aromatic botanical substance. In this example, when the sensate substance is released or emitted from the material of the container the sensate substance evaporates and permeates the chamber. When the evaporated sensate substance encounters a recipient product it will impart on that product an organoleptic characteristic.

Alternatively, the sensate substance may be a liquid which is gradually released from the material and is transferred to the products by contact. The liquid may be an oil or a solution which carries a substance which, when transferred to the recipient product, imparts an organoleptic characteristic to that product.

The sensate substance may provide a flavour to the recipient products 2. As used herein, the terms "sensate substance" and "flavour" refer to materials which, where local regulations permit, may be used to create a desired taste or aroma in a product for adult consumers. They may include extracts (e.g., eucalyptus, licorice, hydrangea, Japanese white bark magnolia leaf, chamomile, fenugreek, clove, menthol, Japanese mint, aniseed, cinnamon, herb, wintergreen, cherry, berry, peach, apple, Drambuie (distilled alcoholic liqueur having a Scotch Whisky base), bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

Alternatively, the organoleptic characteristic may be an aroma, for example a menthol scent or other. A mentholated sensate substance may also create a cooling sensation when the infused product is consumed or used, as well as providing flavour and/or aroma. It will be appreciated that any combination of organoleptic characteristics may be provided by the sensate substance which may also act to provide an aroma to the air in the chamber, such that a consumer can smell the sensate substance on opening the container.

It is noted that, in some embodiments (not shown in the drawings), the chamber 7 may be divided into any number of sub-chambers for storage of the recipient products. In this case, at least a portion of the interior surface of each of the sub-chambers may be provided with a different sensate substance, so that different organoleptic characteristics are imparted on the recipient products in different sub-chambers. The recipient products in each sub-chamber may be the same or they may be different.

It should also be clear that, in embodiments, any number of recipient products may be used.

In order to address various issues and advance the art, the entirety of this disclosure shows by way of illustration various embodiments in which the claimed invention(s) may be practiced and provide for a superior container. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smokeless tobacco product container comprising:

a main body;

a removable lid;

a chamber defined by the main body and the removable lid;

wherein when the main body is push-fit to the removable lid, a hermetic seal is established therebetween, thereby sealing the chamber from an outside environment;

a polymer material infused or impregnated with a sensate substance, said polymer material being a polymer foam and making up at least a portion of the container, the container being provided with an inner layer which is made from the polymer material which is integrally formed with the container so that said sensate substance is provided without a separate member; and a smokeless tobacco product;

wherein the sensate substance is a volatile substance that can be released into the chamber while the chamber is hermetically sealed, such that the volatile substance evaporates and permeates within the chamber and imparts an organoleptic characteristic to the smokeless tobacco product;

wherein the portion comprises an insert which is received in the container, said insert being made from the material which contains the sensate substance which is released into said chamber, and wherein the chamber has a recess that is recessed from an internal surface of the container, the insert being received in the recess.

2. The container of claim 1, wherein the main body comprises said portion of the container which is made from the material which is provided with a sensate substance.

3. The container of claim 1, wherein the removable lid comprises said portion of the container which is made from the material which is provided with a sensate substance.

4. The container of claim 1, wherein the portion of the container which is made from the material which is provided with a sensate substance is an internal surface of the chamber.

5. The container of claim 1, wherein the container comprises a permeable layer disposed between the portion of the container made from the material which is provided with a sensate substance and said chamber.

6. The container of claim 1, wherein the sensate substance is an aromatic substance.

7. The container of claim 1, wherein the insert is received within the main body of the container, said insert defining at least a part of the internal surface of the chamber.

8. The container of claim 7, wherein the insert is shaped to match the internal shape of the main body such that the insert is received within the main body and covers the internal surface of said main body to define said chamber.

9. The container of claim 7, wherein the insert is a different shape to the internal shape of the main body, so that it only partially covers the internal surface of the chamber.

10. The container of claim 1, wherein the insert is shaped to match the internal shape of the removable lid such that the insert is received within the removable lid and covers the internal surface of said removable lid to define said chamber.

11. The container of claim 1, wherein the sensate substance is a botanical substance.

12. The container of claim 1, wherein the smokeless tobacco product is a snus tobacco product.

13. The container of claim 1, wherein the container is pocket-sized.

14. The container of claim 1 wherein when the main body is push-fit to the removable lid, an overlapping and/or interlocking relationship is established therebetween.

15. The container of claim 1 for a pouched product, further comprising:

a plurality of pouched product portions stored within the chamber, wherein the sensate substance is released into the chamber and transferred to the pouched product portions stored within the chamber to impart the organoleptic characteristic to the pouched product, the sensate substance in the container without a separate member.

16. The container of claim 15, wherein the pouched product comprises nicotine or a non-tobacco plant material.

17. A method of manufacturing the smokeless tobacco product container of claim 1 comprising the step of:

forming the portion of the container from the polymer foam material which is infused or impregnated with the sensate substance during manufacture of the polymer foam material, and wherein the sensate substance is released into the chamber and transferred to a recipient product in the container to impart the organoleptic characteristic on the recipient product.

18. A method of using the smokeless tobacco product container of claim 1 comprising placing the smokeless tobacco product in the chamber.

* * * * *